US007673481B2

(12) United States Patent
Amir

(10) Patent No.: US 7,673,481 B2
(45) Date of Patent: Mar. 9, 2010

(54) KEY SAFE APPARATUS AND METHOD

(76) Inventor: Haim Amir, Yiftach 6B, Ramat Hasharon (IL)

( * ) Notice: Subject to any disclaimer, the term of this patent is extended or adjusted under 35 U.S.C. 154(b) by 185 days.

(21) Appl. No.: 11/535,993

(22) Filed: Sep. 28, 2006

(65) Prior Publication Data

US 2008/0078223 A1 Apr. 3, 2008

(51) Int. Cl.
*B65D 55/14* (2006.01)
*E05G 1/00* (2006.01)

(52) U.S. Cl. ..... 70/63; 70/278.1; 109/45; 109/50; 109/52; 109/54

(58) Field of Classification Search ..... 70/63, 70/278.1, 278.2; 109/45, 47, 50–52, 54, 109/56, 57, 59 R
See application file for complete search history.

(56) References Cited

U.S. PATENT DOCUMENTS 1,885,692 A * 11/1932 Dugan ..... 40/660
2,672,043 A * 3/1954 Folscheid ..... 70/447
3,084,008 A * 4/1963 Mallett ..... 312/319.1
3,744,281 A * 7/1973 Logue et al. ..... 70/58
3,795,417 A * 3/1974 Cohen ..... 292/144
4,296,617 A * 10/1981 Campagna ..... 70/63
4,609,780 A * 9/1986 Clark ..... 379/102.06
4,615,281 A * 10/1986 Gaston ..... 109/50
4,655,145 A * 4/1987 Naylor ..... 109/52
4,727,368 A * 2/1988 Larson et al. ..... 340/5.6
4,768,021 A * 8/1988 Ferraro ..... 340/568.1
4,829,796 A * 5/1989 Kim ..... 70/168
5,060,491 A * 10/1991 Smith ..... 70/63
5,156,030 A * 10/1992 Hill et al. ..... 70/63
5,280,518 A * 1/1994 Danler et al. ..... 379/102.06
D344,442 S * 2/1994 Myers ..... D8/341
5,423,198 A * 6/1995 DiVito et al. ..... 70/278.3
5,437,174 A * 8/1995 Aydin ..... 70/278.3
5,550,529 A * 8/1996 Burge ..... 340/5.6
5,758,522 A * 6/1998 York ..... 70/63
5,999,095 A * 12/1999 Earl et al. ..... 340/542
6,047,575 A * 4/2000 Larson et al. ..... 70/278.1
6,430,977 B1 * 8/2002 Berstis et al. ..... 70/63
6,472,973 B1 * 10/2002 Harold et al. ..... 340/5.73
6,729,167 B2 * 5/2004 Fredriksson et al. ..... 70/63
7,334,443 B2 * 2/2008 Meekma et al. ..... 70/278.7

* cited by examiner

*Primary Examiner*—Suzanne D Barrett
(74) *Attorney, Agent, or Firm*—Mark M. Friedman

(57) ABSTRACT

A remotely activated and monitored key safe to allow storage and retrieval of at least one key including: a housing having a generally elongated shape and having a longitudinally extending cavity open through a first axial end of the housing, in fixed relation to a structure: a key holding tray adapted to be slideably loaded into the housing, the tray having a front cover fitted to cover the first axial end of the housing, and the tray having a locking/unlocking mechanism; a communications and command subsystem powered by a power source, the communications and command subsystem adapted to receive remote commands to activate the locking/unlocking mechanism; and a backup power subsystem adapted to allow backup power to be applied to contacts presentable on an accessible surface of the key safe in case of a failure of the power source.

19 Claims, 12 Drawing Sheets

KEY SAFE APPARATUS AND METHOD

FIELD AND BACKGROUND OF THE INVENTION

The present invention relates to secure storage of keys and, in particular, it concerns a remotely activated and monitored key safe that can be used to store and retrieve one or more keys.

It is known that keys to open locks of various configurations are stored in close vicinity of such locks for a number of situations including residential and commercial applications, such as where fire officials or others must rapidly gain access to the interior of a building to extinguish a fire or deal with other emergencies or specific security situations or as a back up to aid in case of loss of or damage to keys. In the case of an emergency situation, one known procedure is for a fire official to maintain a key ring with attached keys for buildings located in his fire station zone and to bring the key ring to the emergency location. This procedure allows the fire official access to the lock using one or more of the attached keys. However, this procedure is disadvantageous—mainly because of the critical time it may take to sort through multiple key rings for a vast number of buildings within a given fire station zone. Also, should the appropriate key not be available for whatever reason, in an emergency situation, and the door or window (for example) is destroyed to gain access and emergency personnel are precluded from relocking the premises after dealing with the emergency or with the false alarm. This situation can then place the premises at risk, sometimes more extreme than the initial emergency. Among additional disadvantages with this method is the fact that keys and key rings must continually be updated from many sources and that these keys must also be sorted and stored securely. The logistics and overall cost associated with this method are another strong disadvantage.

A number of devices have been proposed to deal with the situations noted hereinabove. Campagna, in U.S. Pat. No. 4,296,617, whose disclosure is incorporated herein by reference, discloses a high security key receptacle which is attachable to an aperture in a door or like structure having an interior and exterior surface. The receptacle, which holds a key for the door in which the receptacle is mounted, has an open end facing flush with the exterior of the door. A closure plug having a lock closes off the open end of the receptacle. A flange is used to securely fasten the receptacle to the inside surface of the door, preventing extraction of the receptacle through the aperture. The fire department, in response to an emergency situation, can rapidly gain access to the stored key by inserting the fire department key into the closure plug lock, removing the closure plug, and accessing the stored key. The receptacle disclosed by Campagna has a disadvantage in that it still requires a key to open the safe, which must be maintained by emergency personnel (be they the fire department, paramedics, or others) when they approach the exemplary locked door or window.

Other key safes employ combination locks to avoid the disadvantage noted above. Gaston discloses a key safe in U.S. Pat. No. 4,615,281 whose disclosure is incorporated herein by reference. The key safe disclosed by Gaston is deployed in a building door and the safe has an open ended housing secured within and projecting through the door. A safe door is hinged to and closes the end of the housing and has a retractable latch bar engaged with the building door to lock the safe door. A combination lock having buttons on the safe door includes a normally-open printed circuit connected to a power source. A solenoid is connected to the circuit and includes a plunger connected to the latch bar. A tamper proof key tray is nested within the housing and is normally spring biased for ejection inwardly of the building door, thereby ejecting the key from the safe and to the secured side of the building door. A first detent assembly is interposed between the safe door and the tray so that any forceful opening of the safe door disengages the detent assembly. A storage battery is included as the power source for the solenoid.

Some disadvantages of key safes such as described above include:

- the key safe is set into a building door and the safe is not necessarily useful for securing a key for an outdoor application such as a gate, etc.;
- the combination lock or other type of lock used to secure such safes must be physically operated by a person located at the safe, and should the person not be capable of opening the safe (does not have the combination or key, or is a child who cannot operate the combination or lock, etch) the safe cannot be opened;
- the safe may be inoperable upon battery failure; and
- except for physically inspecting and opening the safe, there is no way to readily determine the state (locked, unlocked, damaged, etc.) of the safe or of its contents.

There is therefore a need for a secure, remotely activated and monitored key safe that can be used to securely store and retrieve one or more keys and/or other similarly shaped objects.

SUMMARY OF THE INVENTION

The present invention is a remotely activated and monitored key safe to allow storage and retrieval of one or more keys and/or other similarly shaped objects.

According to the teachings of the present invention there is provided, a remotely activated and monitored key safe to allow storage and retrieval of at least one key including: a housing having a generally elongated shape and having a longitudinally extending cavity open through a first axial end of the housing, in fixed relation to a structure: a key holding tray adapted to be slideably loaded into the housing, the tray having a front cover fitted to cover the first axial end of the housing, and the tray having a locking/unlocking mechanism; a communications and command subsystem powered by a power source, the communications and command subsystem adapted to receive remote commands to activate the locking/unlocking mechanism; and a backup power subsystem adapted to allow backup power to be applied to contacts presentable on an accessible surface of the key safe in case of a failure of the power source.

Preferably, the locking/unlocking mechanism includes a motor adapted to radially displace a plurality of bolts from the tray when the tray is loaded substantially completely into the housing, yielding a closed state, the locking/unlocking mechanism adapted to yield a locked state of the tray wherein axial movement of the tray is substantially inhibited, and an unlocked state of the tray wherein axial movement of the tray is possible and the tray may be slid towards the first axial end of the housing, yielding an open state. Most preferably, the communications and command subsystem is adapted to be integrated into the key holding tray and the communications and command subsystem includes at least a transceiver, sensors, a processors and an antenna. Typically, the sensors are adapted to sense and monitor at least one of a group of states including: closure; opening; locking and unlocking of the safe tray; presence and no presence of the key in the tray; and status of the power supply. Further typically, the processor is adapted to process sensor inputs and to provide telemetry information to a remote receiver regarding the inputs, thereby indicating the states of the safe. Preferably, the processor is adapted to process commands from a remote location to command the communications and command subsystem.

Preferably, the communications and command system is configured to receive and send respective command and telemetry information which is transferable by either wireless, wired, or wireless and wired communication. Preferably, the power source is a battery and power is supplied via wires from a remote source of electricity. Typically, a spring bias mounted on the second axial end of the tray urges the tray to slide out from the housing. Preferably, the structure has a first surface and the housing is adapted to be mounted substantially within the structure and substantially perpendicular to the first surface, with the first axial end open towards the first surface. Most preferably, the structure has a second surface and the housing has a second axial end extending to a second surface of the structure. Typically, the structure is a door.

Preferably, the structure has a first surface and wherein the housing is adapted to be mounted substantially parallel to the first surface. Typically, the structure is a wall.

According to the teachings of the present invention there is also provided a method of remotely activating and monitoring a key safe to allow storage and retrieval of at least one key comprising the steps of: providing a housing having a generally elongated shape and having a longitudinally extending cavity open through a first axial end of the housing, the housing mounted securely within a structure and with the first axial end mountable securely in conjunction with a structure; configuring a key holding tray which is slideably loaded into the housing, the tray having a front cover fitted to cover the first axial end of the housing, and the tray having a locking/unlocking mechanism; and providing a communications and command subsystem powered by a power source to receive remote commands to activate the locking/unlocking mechanism. Preferably, the communications and command subsystem is integrated into the key holding tray. Most preferably, backup power is applied to contacts presentable on an accessible surface of the key safe in case of a failure of the power source.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a key safe apparatus and methods to remotely activate and monitor the key safe, which can be used to store and retrieve one or more keys.

The principles and operation of the key safe according to the present invention may be better understood with reference to the drawings and the accompanying description. The term "key" as used hereinbelow, generally refers to a device that can be used to open a lock, or to any other object of similar or smaller geometry that may be securely stored in the key safe apparatus described hereinbelow.

Figure 1:
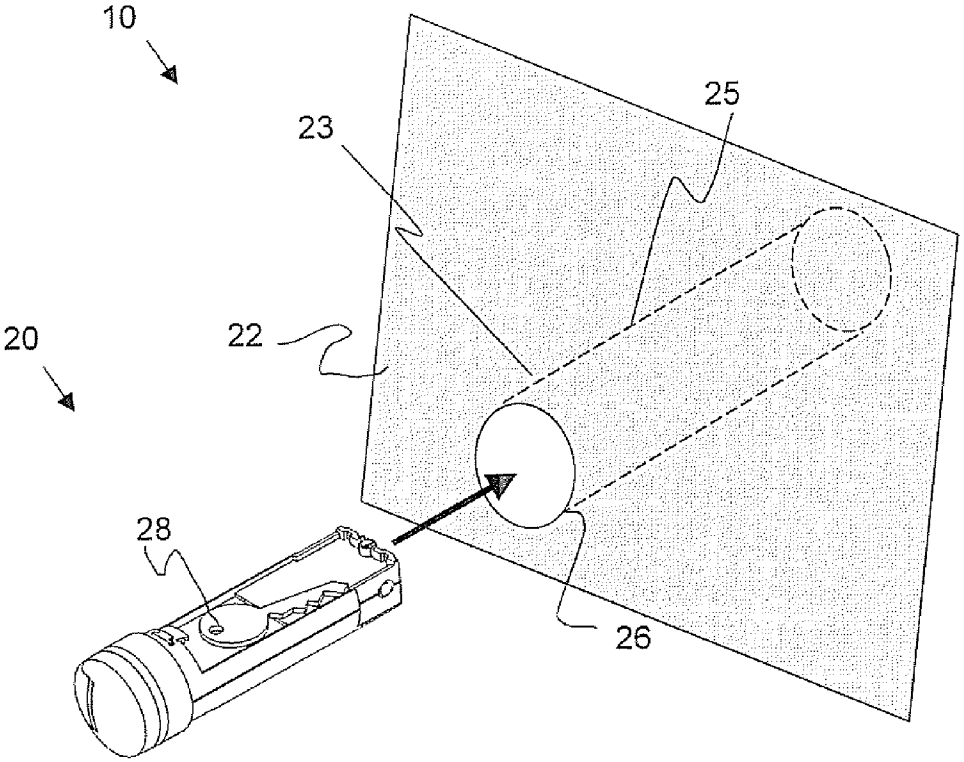
FIG. 1 is a schematic illustration of a key safe apparatus having a safe tray, an exterior surface of a structure, an opening of the structure, and a housing securely fit within the opening, in accordance with of an embodiment of the present invention.

Referring now to the drawings, FIG. 1 is a schematic illustration of a key safe apparatus 10 having a safe tray 20, an exterior surface 22 of a structure, an opening 23 of the structure, and a housing 25 securely fit within the opening, in accordance with of an embodiment of the present invention. The structure may include any solid surface including a building wall, a retaining wall, a door, or any material into which housing 25 may be securely fit, as described hereinbelow. Safe tray 20 is designed and to be inserted and withdrawn from a front opening 26 of housing 25. Safe tray 20 typically holds a key 28, although more than one key may be held by the tray. Additionally or alternatively, any device or object which has the approximate shape of key 28 and which is to be securely stored may be held by safe tray 20. The key safe tray is supported within the housing upon rails or guides (not shown in the figure). When in a closed state, key safe tray 20 is fully inserted into housing 25, whereupon the key safe tray may then be locked and tray movement is inhibited, with the aid of internal ridges or retaining stopper structures (not shown in the figure) formed in the internal surface of housing 25 near the end furthest from front opening 26, as described hereinbelow. When in an opened state, safe tray 20 may be partially or completely removed from housing 25 so that key 28 may be removed from and inserted into the safe tray.

Figure 2:
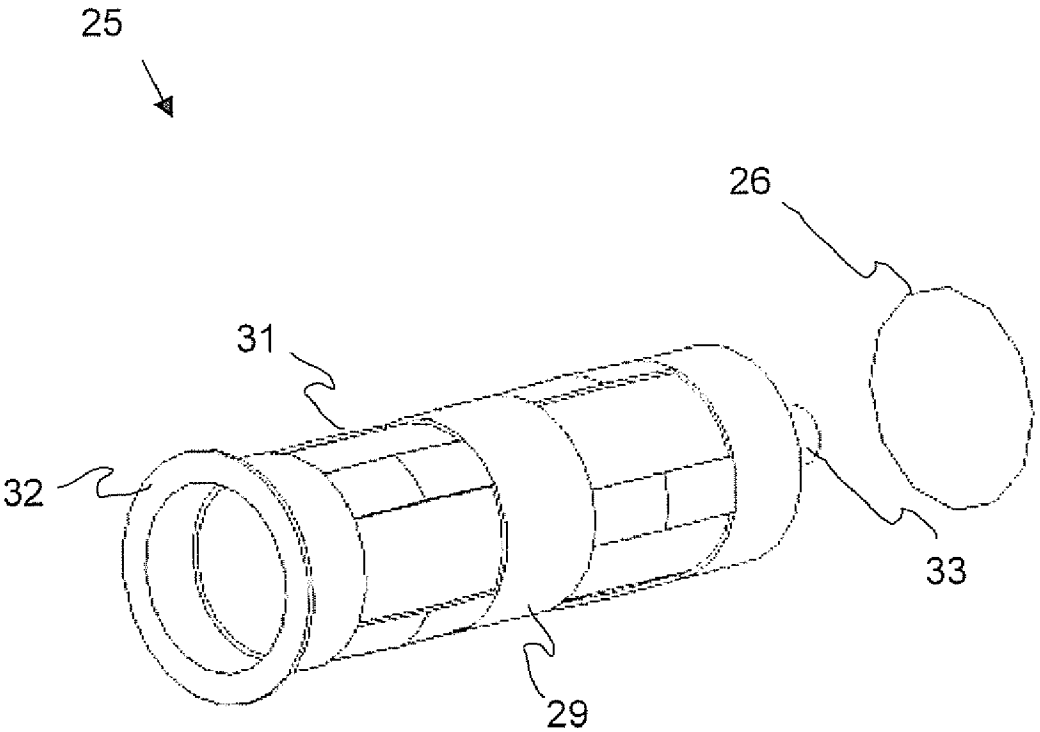
FIG. 2 is a schematic illustration of the housing and the opening of FIG. 1, in accordance with an embodiment of the present invention.

Reference is now made to FIG. 2, which is a schematic illustration of housing 25 and front opening 26 of opening 23 of FIG. 1, in accordance with an embodiment of the present invention. Housing 25 has a longitudinal axis and typically comprises three or more metallic flattened and rigid ring structures 29 configured parallel to one another generally concentrically, along the longitudinal axis of the housing. The ring structures are typically connected radially to one other by three or more flatted metal pieces 31, as shown in the figure. Metal pieces 31 are formed so that after housing 25 is fully inserted into front opening 26, when a longitudinal compressive force is applied to the housing, as described hereinbelow, the metal pieces deform outwardly in a radial direction normal to the housing axis, thereby causing the metal pieces to press tightly and lock against the walls of opening 23 shown in FIG. 1. In another embodiment of the current invention, housing 25 is constructed to be locked securely, as known in the art, in a wall or material that is not completely solid, such as but not limited to cinderblock and hollowed brick materials.

A front flange 32 is securely and rigidly fixed to one end of the housing, so that when the housing is inserted into front opening 26, the front flange securely fits flush within or slightly recessed into opening 23. A fitting 33 is rigidly attached to the other end of the housing, opposite from the front flange, typically to a ring structure. Fitting 33 has a tapped central bore (not shown in the figure) to receive a threaded bolt. A compressive force is applied to the housing by inserting a bolt, which is free to turn but longitudinally constrained against front flange 32, into the bore of fitting 33 and by tightening the bolt. Once the housing is securely locked into position, the bolt may be removed. Other configurations of the housing may be employed, as known in the art, to tightly secure the housing within opening 23.

Figure 3:
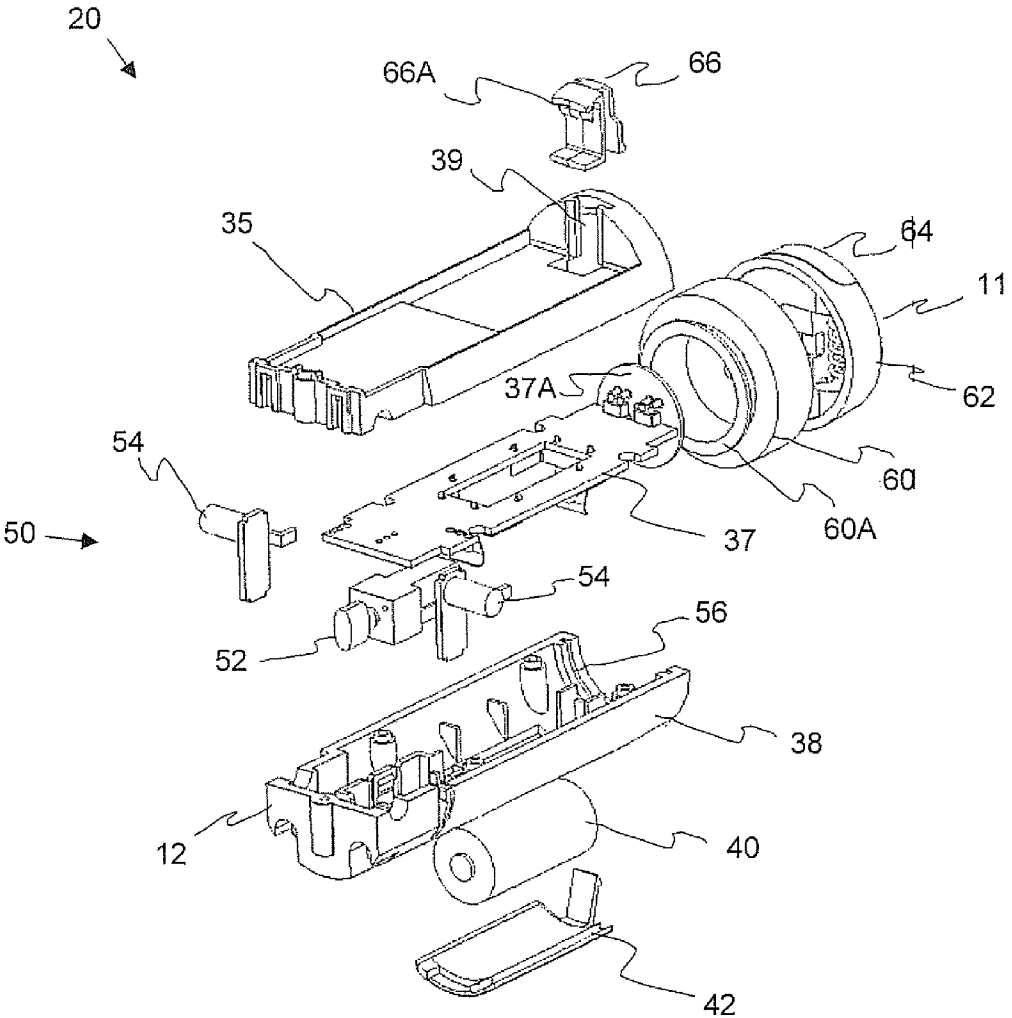
FIG. 3 is an exploded illustration of the safe tray of FIG. 1, in accordance with an embodiment of the present invention.

Reference is now made to FIG. 3, which is an exploded illustration of safe tray 20 of FIG. 1, in accordance with an embodiment of the present invention. One embodiment of safe tray 20 comprises a generally elongated cylindrical shape having a longitudinal axis. A front end 11 of safe tray 20 defines the axial end of the tray which is closest to front flange 32 (refer to FIG. 1) when the safe tray is closed. A back end 12 of safe tray 20 defines the axial end of the tray opposite the front end. The safe tray is defined by three major lateral parts: a tray shelf 35; a circuit layer 37; and a lower shell 38. Tray shelf 35 has a generally flat shape with a depression in its upper flat surface in which key 28 (as seen in FIG. 1) may be placed. Tray shelf 35 has an integrated nearly-semicircular edge at the front end. Circuit layer 37 has a generally flat shape with an integrated circular edge 37A at the front end. Electronic components (not shown in the figure) are located on and under circuit layer 37 and are responsible for a plurality of electronic functions of the safe tray, as described hereinbelow. The circuit layer is positioned between tray shelf 35 and lower shell 38. Lower shell 38 has a generally semicircular cross section and a power source 40 (shown as a battery in the figure) is positioned within the lower shell generally parallel to the longitudinal axis. The power source is accessible by an opening (not shown in the figure) within lower shell 38. The opening is covered by a battery cover 42, which is fitted to the curved contour of lower shell 38. A locking/unlocking subsystem 50 is located within the lower shell, near the back end. Some parts of the locking/unlocking subsystem seen in the figure are an eccentric driver 52 and locking ears 54. Other components of locking/unlocking subsystem 50 and its functioning, are described hereinbelow in a separate figure. Power source 40, in addition to being a battery, as shown in the figure, may be an alternate power source such as a wired source (not shown in the figure). In an embodiment employing the wired power source, power wires may be supplied to the housing and power contacts may be provided to interface and contact the safe tray when it is closed. Power source 40 serves to power all electronic functioning of the key safe, as described hereinbelow. In the case of the wired power source, as mentioned above, an alternate or additional configuration may be to use the wired power source to maintain the charge of an on-board battery.

Upper tray 35 has a groove (not seen in the figure) formed within its nearly-semi circular edge and lower shell 38 has a corresponding groove 56 formed its semi-circular front end. When circuit layer 37 is assembled in position between tray shelf 35 and lower shell 38, a circular front end ring 60 having a circular lip 60A, is held in position by mating the circular lip, which is held by the respective grooves of respective edges of upper tray 35 and lower shell 38. Furthermore, when circuit layer 37 is assembled in position, as described above, circular edge 37A protrudes through circular front end ring 60. A front end piece 62, having a front end mounted front cover 64, mates with the front end of circular front end ring 60. Circuitry (not shown in the figure) within circuit layer 37 is electrically connected to circular edge 37A and contacts (not shown in the figure) on the front face of circular edge 37A make electrical contact with contacts (not shown in the figure) on the back face of front end piece 62.

A clip cutout 39 is located in the front end of tray shelf 35 and is shaped to receive a retaining clip 66, which fits into and is securely maintained in a protruding position through the clip cutout, by means of spring-action of the retaining clip. Retaining clip 66 has back-facing spring-loaded teeth 66A, which serves to retain key 28.

Electronic components (not shown in the figure) on and under circuit layer 37 include, but are not limited to: a communications and command subsystem and power management subsystem. The electronic components are responsible for sensing functions, such as but not limited to: the presence of the key in the safe tray; locked/unlocked state of the key safe; and power level of the power source or battery. The communications and command subsystem function to control reception of remote commands and queries, management of sensors, transmitting of key safe telemetry information, and unlocking/locking the key safe. The communications and command subsystem includes: a processor, a transceiver, an antenna, and sensors—all not shown in the figure. Remote commands and telemetry signals may be transmitted by wireless, wired, or wireless and wired means. In one embodiment of the present invention, the communications and command subsystem is not configured on circuit layer 37, but in an alternative location (not shown in the figure), such as within the structure and/or attached to the housing. An off-tray configuration of the communications and command subsystem would include at least one electrical connection (not shown) to the power management system.

Typical operation of key safe apparatus 10 by a user can include: placing/securing the key in the retaining clip of safe tray 20; completely sliding the safe tray into housing 25; and remotely commanding (for example, from a command center or from a remote control device) locking/unlocking subsystem 50 to lock the safe tray.

Sensing functions, as noted above, can be continuously operational and the key safe apparatus transmits signals reflecting the sensor states to a remote location, such as, but not limited to a remote command center or to a remote control device. The presence of the key in the safe tray; locked/unlocked state of the key safe; and power level of the power source or battery are among the key safe states which may be remotely monitored. Should a malfunction or undesirable state be indicated at the remote location, the key safe may be remotely queried to verify the undesirable state. Alternately or additionally, knowledge of an undesirable key safe state may warrant sending someone to inspect and remedy the situation at the key safe site. Remote communication with and from the key safe further allows the safe to be unlocked and locked and/or tested, for example, in coordination with an authorized individual located at the key safe site.

Figure 5:
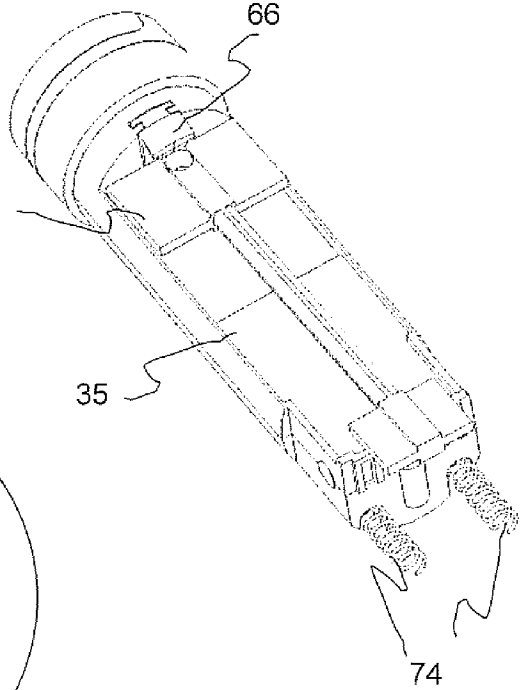
FIGS. 4 and 5 are schematic illustrations of the safe tray of FIG. 1 and FIG. 3.
Figure 4:
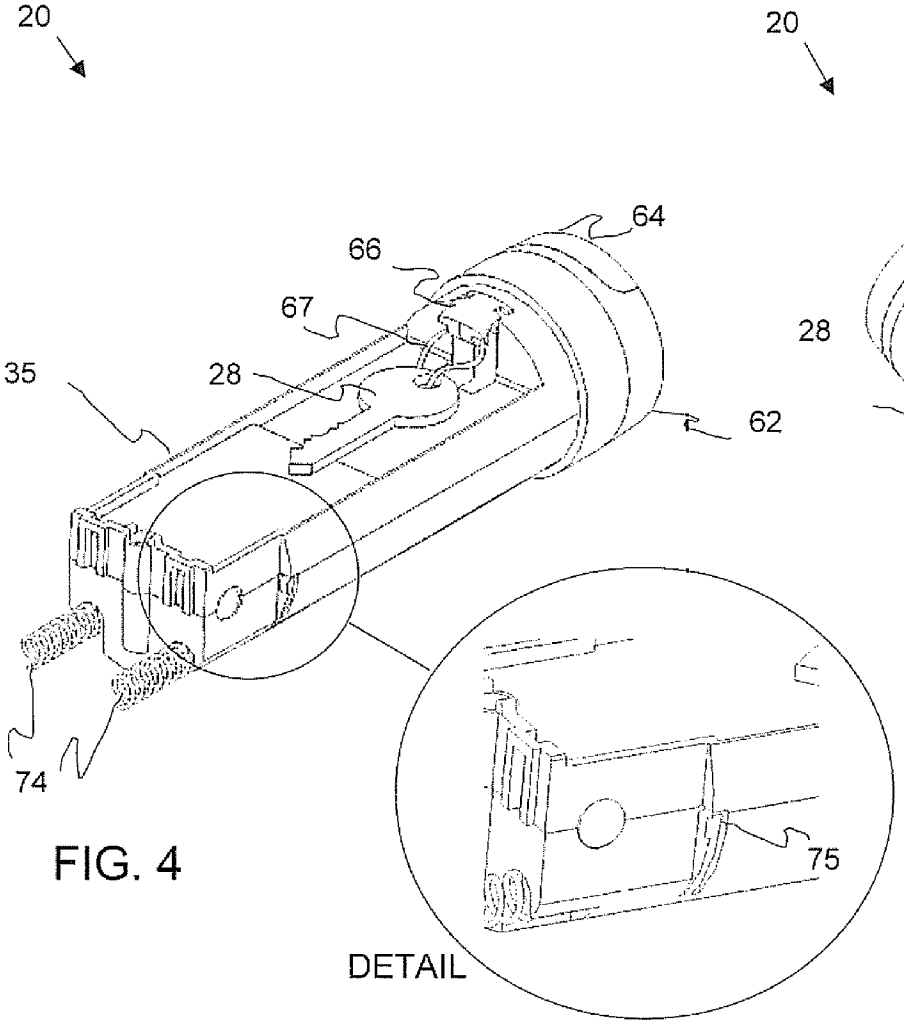

Reference is now made to FIGS. 4 and 5, which are schematic illustrations of safe tray 20 of FIG. 1 and FIG. 3, in accordance with embodiments of the present invention. Apart from differences described below, elements indicated by the same reference numerals of previous figures are generally identical in configuration and operation. In FIG. 4, key 28 rests within upper tray 35 and the key is attached to a key retaining ring 67, which is clasped by retaining clip 66. In this configuration, key 28 is securely attached to the safe tray. In addition to key retaining ring 67, any additional mechanism, such as, but not limited to: cable; string; wire; and retractable magazines of such; may be used to retain the key securely, while allowing it to be retracted from safe tray 20. In FIG. 5, key 28, of another configuration, is held directly in position with upper tray 35, by spring action of retaining clip 66. In this configuration, key 28 is unclipped from retaining clip 66 in order for the key to be used. Both figures serve to show embodiments of various shapes sizes of key 28.

Bias springs 74 located at the back end of safe tray 20 serve to provide a spring bias to the safe tray acting to urge safe tray 20 out from the housing when the safe tray is unlocked. When the safe tray is fully inserted into the housing, contact switch 75 (shown in the detail of FIG. 4) is pressed and activated. The contact switch is connected to the electronic components on circuit layer 37 (refer to FIG. 3). Activation of the contact switch serves to activate the tray locking mechanism described hereinabove. The spring bias serves as a mechanical check that the tray has been successfully locked, in that the tray is maintained fully-inserted within the housing.

Reference is now made to FIGS. 6A through 6D, which are schematic illustrations of front cover 64 of the safe tray, contacts 80 for backup power to be applied to the key safe, a backup battery power source 82 attached to the contacts, and an RF antenna 85 configured within front end piece 62, which serves as a hinge for front cover 64, in accordance with an embodiment of the present inventions. Apart from differences described below, elements indicated by the same reference numerals of previous figures are generally identical in configuration and operation. As noted hereinabove, the key safe is typically powered by power source 40 (see FIG. 3). However, when there is a power failure to the key safe, for example when power source 40, in the form of a battery, is depleted and it is necessary to maintain electrical functioning of the key safe, backup battery power source 82, which may be in the form of a 9-volt battery, is externally connected to the key safe. Battery power source may be connected to the key safe by opening cover 64 and by connecting the backup battery power source to contacts 80. Contacts 80 make electrical connection with the back face of front end piece 62 and with circuitry of the safe tray, as described hereinabove in FIG. 3. Alternatively or additionally, any external power source having appropriate voltage and current characteristics (in this case, those generally similar to a 9-volt battery) may be employed to connect to contacts 80. RF antenna 85 is similarly electrically connected through front end piece 62 and to circuitry within the safe tray, such circuitry responsible for reception and transmission of signals to a remote station.

Figure 7B:
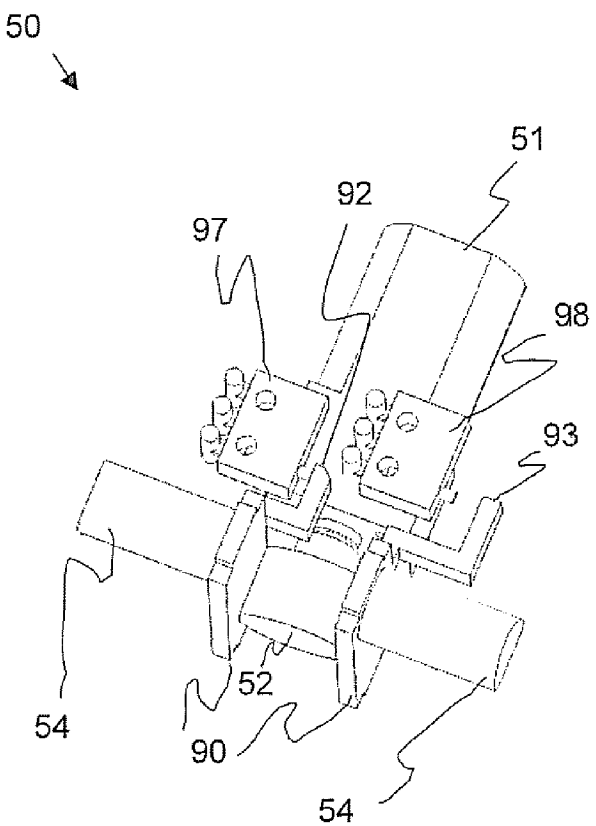
FIGS. 7A and 7B are detailed schematic illustrations of the locking/unlocking subsystem of the key safe, in accordance with an embodiment of the present invention.
Figure 7A:
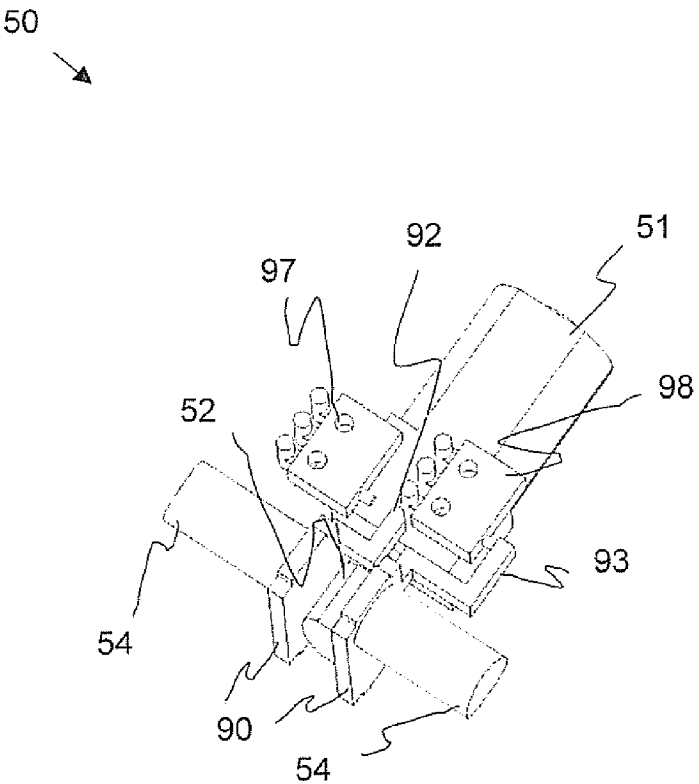

Reference is now made to FIGS. 7A and 7B, which are detailed schematic illustrations of locking/unlocking subsystem 50 of the key safe, in accordance with an embodiment of the present invention. Apart from differences described below, elements indicated by the same reference numerals of previous figures are generally identical in configuration and operation. FIG. 7A is an illustration of locking/unlocking subsystem 50 in an unlocked state, whereas FIG. 7B is an illustration of locking/unlocking subsystem 50 in a locked state—as described hereinbelow. Motor 51 is horizontally mounted substantially parallel to the longitudinal axis of the key safe and rotationally drives eccentric driver 52. Eccentric driver 52 is located between spring-loaded vertical plates 90. Vertical plates 90 have left and right sensor flags 92 and 93 rigidly and generally perpendicularly attached, as shown. Vertical plates 90 are spring-biased against eccentric driver 52. (Spring-biasing may be accomplished by a leaf spring, not shown in the figure, connecting vertical plates 90 or by any other method known in the art.) Locking ears 53 are rigidly attached and extend perpendicularly and generally radially to vertical plates 90. Movement of the vertical plates away from each other correspondingly yields movement of locking ears 53 away from each other, and movement of the vertical plates towards each other correspondingly yields movement of the locking ears towards each other. When moved away from each other, locking ears 53 serve to inhibit axial movement of the safe tray, i.e. "locked" state, by engaging into internal ridges or retaining stopper structures (not show in the figure) in the housing, as noted in FIG. 1. Conversely, when locking ears are retracted towards each other axial movement of the tray is allowed, i.e. "unlocked" state.

Eccentric driver 52 has a generally elliptic shape, having a wider and a narrower width. When motor 51 rotates the eccentric driver so that the narrower width of the eccentric driver is presented between the vertical plates 90, the plates assume the closest vertical configuration to one another—refer to FIG. 7A. When motor 51 rotates the eccentric driver so that the wider width of the eccentric driver is presented between the vertical plates 90, the plates assume the furthest vertical configuration to one another, as shown in FIG. 7B. In one embodiment of the current invention, sensor flags 92 and 93 are shaped and positioned so that when vertical plates are moved the respective sensor flags alternately engage and disengage respective contact sensors 97 and 98, which are rigidly connected to the (non-rotating) body of motor 51. Sensor flag 92 is configured to engage sensor 97 when the plates (and locking ears) are at their furthest proximity and to disengage when the plates and locking ears are moved towards other. Sensor flag 93 is configured to engage sensor 98 when the plates (and locking ears) are in their closest proximity and to disengage when the plates and locking ears are moved away from each other. The configuration of sensor flags 92 and 92 with their respective sensors allows a cross-check indication of "locked" and "unlocked" state. Alternative embodiments of the current invention have alternate respective configurations of the sensor flags and the sensors, mutatis mutandis, that yield alternative "locked" and "unlocked" state indications. Whereas a preferred example of locking/unlocking subsystem 50 as described hereinabove, utilizes motor 51 and additional components, other types of actuators may be used, as is clear to one skilled in the art.

Although housing 25, opening 26 and safe tray 20 are shown in FIGS. 1 to 5, 6D, and 8A-C as having a general circular cross section, other embodiments of the present invention may have any geometric cross section, such as a rectangle square, triangle, etc. may be suitable.

Figure 6C:
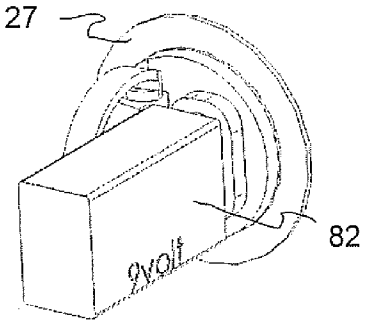
FIGS. 6A through 6D are schematic illustrations of the cover of the safe tray, contacts for backup power to be applied to the tray, a backup battery power source attached to the contacts, and an RF antenna configured within the hinge of the cover, in accordance with an embodiment of the present invention.
Figure 6B:
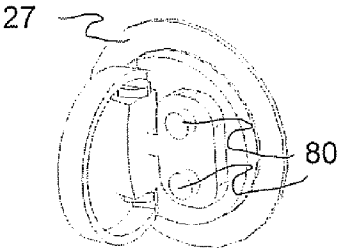
Figure 6A:
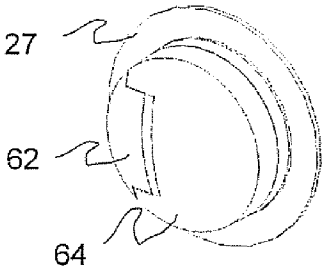
Figure 6D:
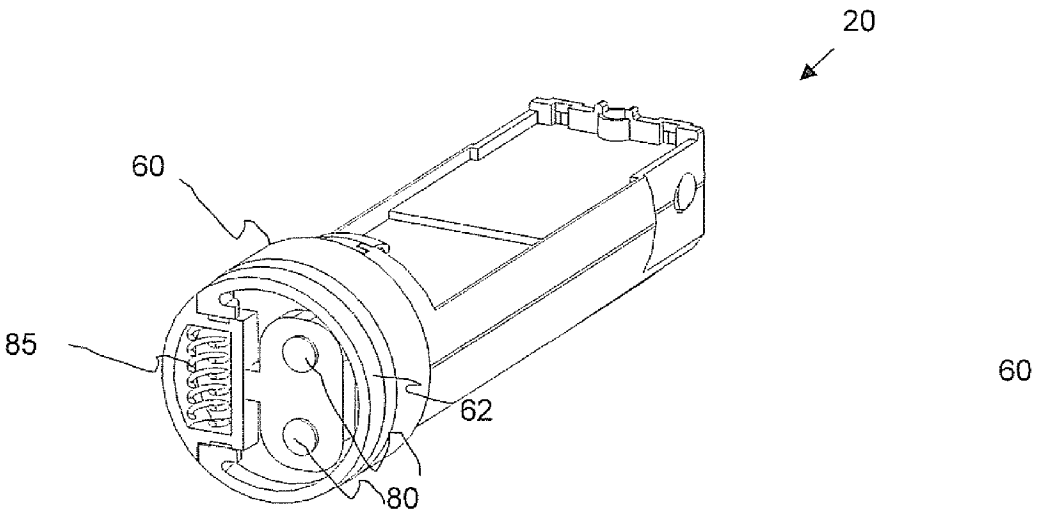

While the power source and the backup battery power source are respectively shown in FIGS. 3 and 6C as batteries, any alternate power source may be respectively connected to the key safe and to the safe tray, including a remote power source and appropriate wiring and contacts. Any combination of sensor-flag configurations may be employed in locking/unlocking subsystem 50 as shown in FIGS. 7A and 7B, including, but not limited to mechanical contact sensor-flag and infra red sensor-flag configurations.

Figure 8A:
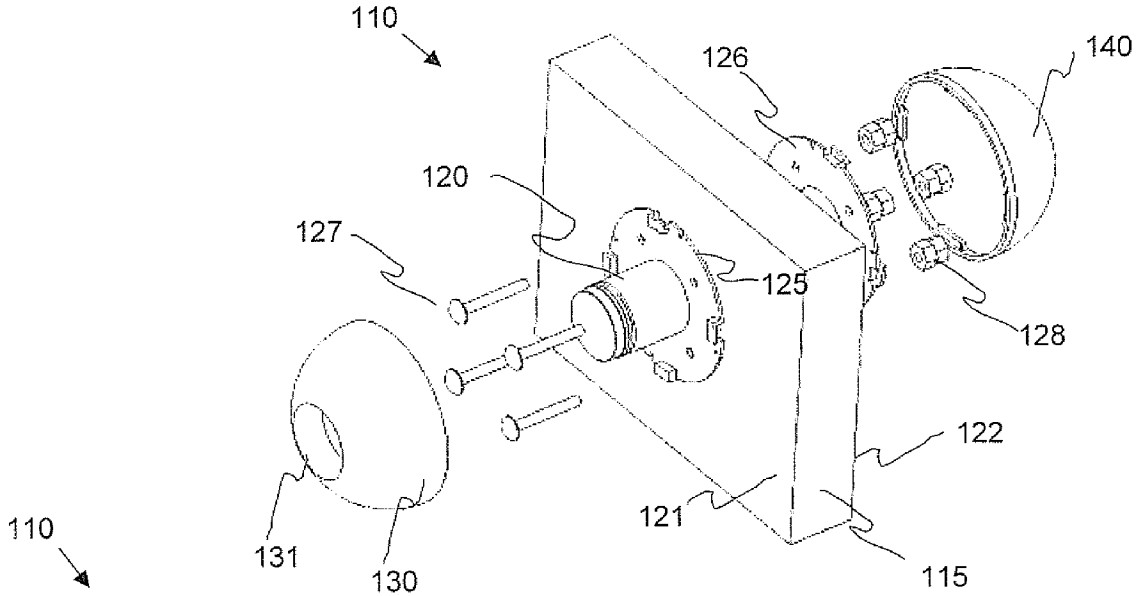
FIGS. 8A through 8C are schematic illustrations of a key safe apparatus having a safe tray, a first surface of a structure, and a second surface of a structure in accordance with of an embodiment of the present invention.
Figure 8C:
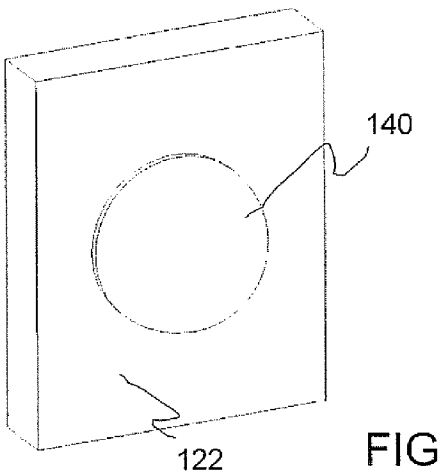
Figure 8B:
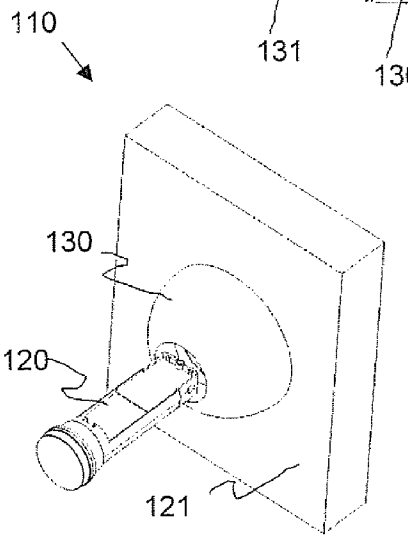

Reference is now made to FIGS. 8A through C, which are schematic illustrations of a key safe apparatus 110 having a safe tray 120, a first surface 121 of a structure, and a second surface 122 of a structure 115, in accordance with of an embodiment of the present invention. Key safe apparatus 110 and safe tray 120 are generally similar in function and configuration to key safe apparatus 10 and safe tray 20, respectively, as shown in FIGS. 1 and 3, however, key safe apparatus 110 is configurable within in a structure having a thickness less than the length of safe tray 120, so that a safe housing (not show in the figure) within which safe tray 120 slides, is secured from both surfaces of the structure, as shown in the figure and as described hereinbelow. A door or a narrow but sturdy wall or partition are examples of typical structures through which safe apparatus 110 may be configured.

First surface fitting 125 and second surface fitting 126 are respectively mounted to first and second surfaces of the structure by bolts 127, which pass through structure 115, and which are locked in position by nuts 128. The first and second fittings securely fix the safe housing (not shown in the figure) in position, generally perpendicularly to surfaces 121 and 122, and they also serve to securely fix convex-shaped first protective cover 130 and convex-shaped second protective cover 140 in position, with their respective circumferential surfaces fitting snuggly against the respective structure surfaces. The two protective covers are designed with convex shapes to provide a secure enclosure for safe tray that may extend to either side of the surface. Four bolts 127 and nuts 128 are shown in the figure, but fewer or more pairs of bolts and nuts may be used to ensure securely fixing all components in place, as described hereinabove.

First protective cover 130 has a central hole 131, allowing safe tray 120 to be removed and inserted. Safe tray 120 may be fully inserted and locked in position, similarly to that of safe tray 20. Second protective cover 140 serves to close and secure the end of the key safe apparatus on the side of the second surface of the structure, through which there is no access to key safe tray 120.

Figure 9:
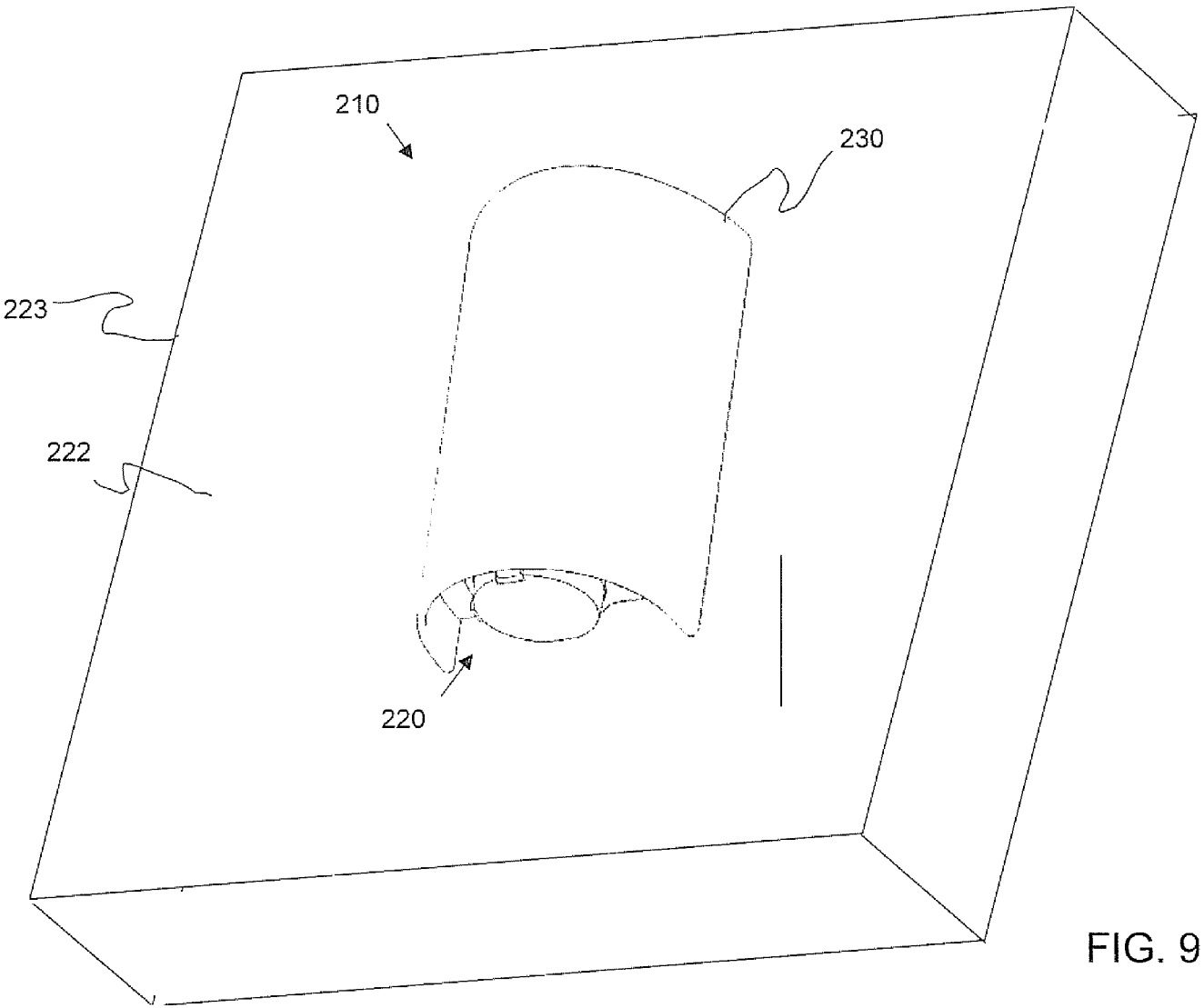
FIG. 9 is a schematic illustration of a key safe apparatus mounted on an external surface of a structure in accordance with an embodiment of the present invention.
Figure 10:
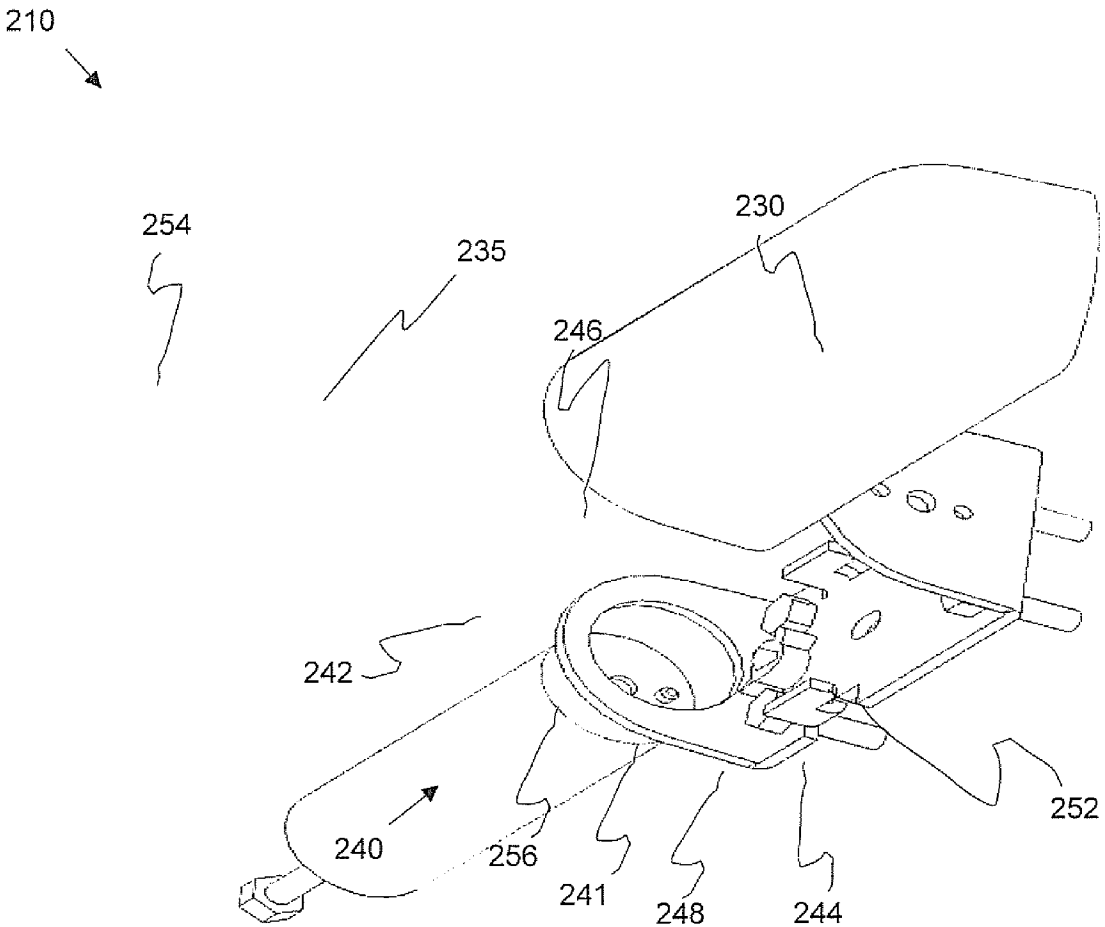
FIG. 10 is an exploded illustration of the key surface apparatus of FIG. 9.
Figure 11:
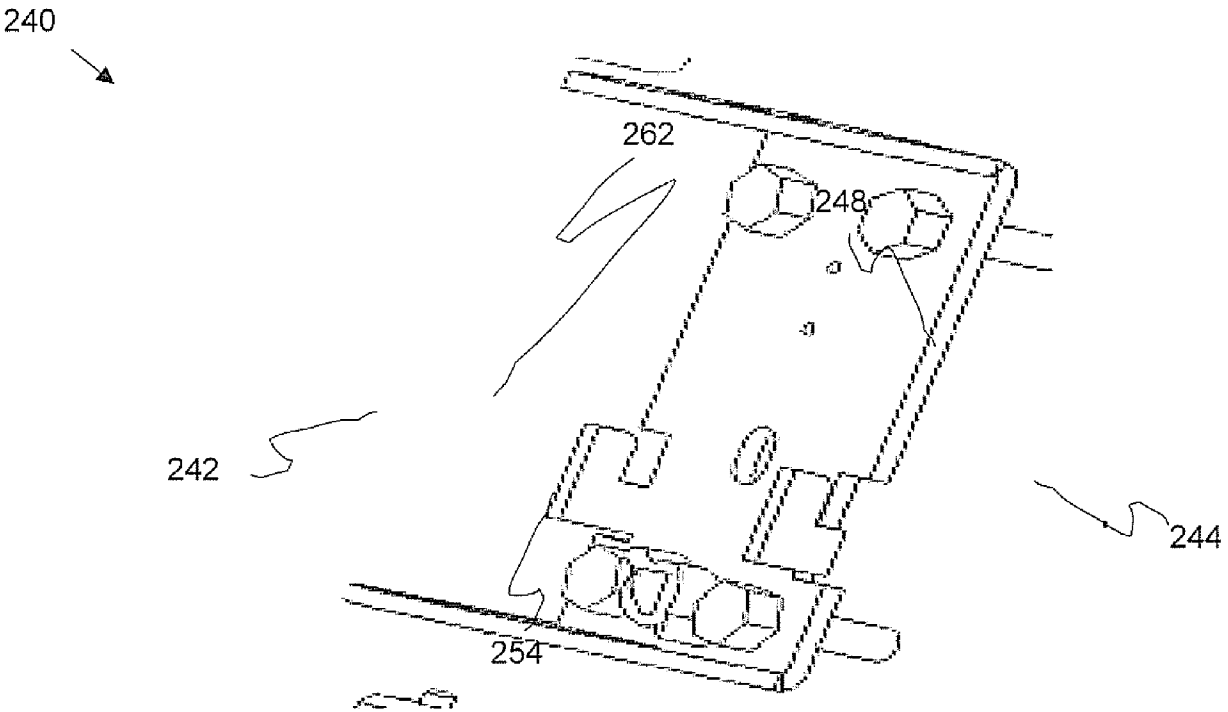
FIG. 11 is a schematic illustration of the mounting bracket shown in FIG. 10.

Reference is now made to FIGS. 9 and 10, which are schematic illustrations of a key safe apparatus 210 mounted on a surface 222 of a structure 223 in accordance with an embodiment of the present invention. Key safe 210 includes: a safe tray 220; a protective cover 230; a housing 235; and a mounting bracket 240. Key safe apparatus 210 and safe tray 220 are generally similar in function and configuration to key safe apparatus 10 and safe tray 20, respectively, as shown in FIGS. 1 and 3, and to safe apparatus 110 and 120, respectively, as shown in FIGS. 8A through C. However, structure 223 (as shown in FIG. 9) is typically a wall, and surface 222 may be an outside surface or an inside surface of the wall; and key safe 220 is typically mounted substantially parallel and against surface 222. Key safe 220 may be positioned near a door. The key safe is typically oriented so that safe tray 220 opens downwards, towards the ground/floor.

Mounting bracket 240 has the general form of a flat rectangularly-shaped base plate 241, having two ends bent substantially perpendicularly to the base plate to form a first mounting ear 244 and a second mounting ear 246, respectively. Both mounting ears have rounded edges as shown in FIG. 10. A circular hole 246 is formed in first mounting ear 242 to receive and securely retain housing 235. Mounting bracket 240 is securely fixed against surface 222 and structure 223 by bolts 248, which pass thru holes (not shown in the current figure) in the mounting bracket. Although four bolts 248 are shown in the figures, fewer or more bolts may be used to firmly secure mounting bracket 240 to the structure. Second mounting ear 244 has a hole 252 to receive bolt 254, which is passed through housing 235 to its closed end, as shown in the figure, when securely fixing housing 235 to bracket 240. Hole 252 may be threaded or a nut (not shown in the figure) may be used to fix bolt 254. Cover locking tabs 256 protrude from base 241 to engage and lock with corresponding catches (not shown in the figure) on the internal surface of cover 230. In this way, protective cover 230 may be locked into position and fitted closely against surface 222, covering and securing housing 235 and bracket 240. Protective cover 230 is shaped with a smooth external contour oil all sides, except where safe tray 220 opens, to allow deflection of any mechanical impacts upon safe apparatus 210. Furthermore, protective cover 230 may be formed with one or more internal reinforcing ribs (not shown in the figures) to enhance mechanical strength and integrity of the cover. A tamper mechanism 262 is located on base 241 in proximity of first mounting ear 244. The tamper mechanism is further described hereinbelow in FIG. 13.

Figure 12B:
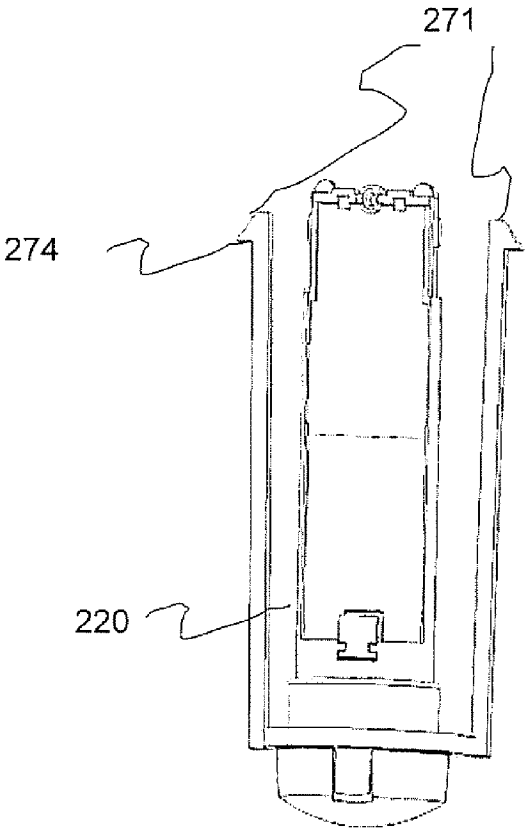
FIGS. 12A-B are schematic illustrations of the key tray of the key safe apparatus shown in FIGS. 9-10.
Figure 12A:
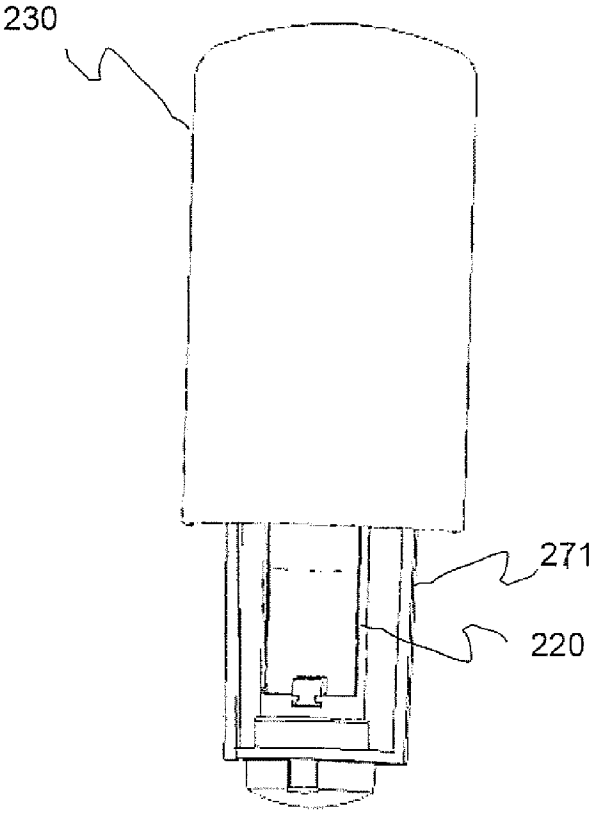

Reference is now made to FIGS. 12A-B, which are schematic illustrations of the key tray shown in FIG. 9. Apart from differences described below, elements indicated by the same reference numerals of previous figures are generally identical in configuration and operation. As noted hereinabove, the key safe is typically mounted so that safe tray 220 opens downwards, towards the ground/floor. The downward orientation is typically preferred so that the safe tray is not easily susceptible to impact, damage, and soiling. Flexible retention ears 271, having retention barbs 274 as shown, are attached to the key tray to inhibit the tray from falling from the housing when the tray is commanded to open. When the tray is a closed or locked position, the retention ears press outwards from the tray and against the inner surface of housing 235 (refer to FIG. 10). When the tray is commanded to unlock, bias springs 74 (refer to FIG. 5) urge safe tray 220 out of the housing as described previously. As the tray partially moves out of the housing, the retention barbs engage corresponding catches (not shown in the figure) formed on the inner surface of the housing, and further downward movement of the tray is inhibited. A user may then press retention ears 271 inward to release the retention barbs from the corresponding catches and then fully retract the safe tray from the housing. The flexible retention ears described hereinabove and shown in the figure represent one of other possible mechanisms known in the art to inhibit further movement of the safe tray when the tray is commanded to unlock.

Key safe 210 is described hereinabove as being mounted so that safe tray 220 opens downwards, towards the ground/floor and with the protective cover completely covering the housing and bracket from above. This configuration allows affords protection from intentional impacts on the key safe, such as but not limited to hammer blows, delivered from above. However, key safe 210 may be mounted in any other desired orientation.

Figure 13:
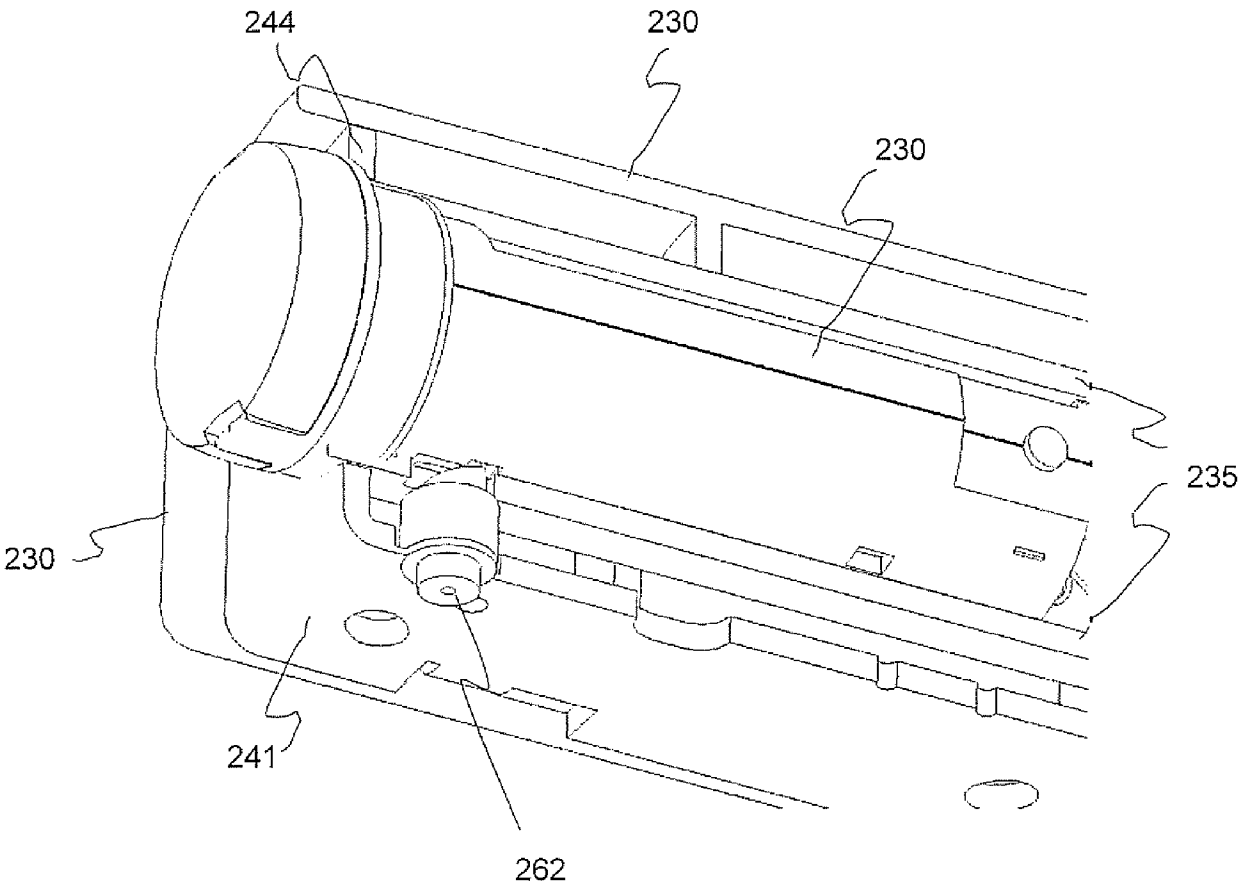
FIG. 13 is a sectional schematic illustration of the key safe apparatus shown in FIGS. 9-10, showing a tamper mechanism, in accordance with an embodiment of the present invention.

Reference is now made to FIG. 13, which is a sectional schematic illustration of the key safe shown in FIGS. 9-10, including tamper mechanism 262, in accordance with an embodiment of the present invention. In the figure, protective cover 230 and housing 240 are shown in sectional view, while safe tray 220 is shown in full view. Apart from differences described below, elements indicated by the same reference numerals of previous figures are generally identical in configuration and operation.

Tamper mechanism 262 includes a surface plunger 282 and an indicator probe 284. Indicator probe 284 is shaped to pass through housing opening 286 and to contact a contact switch (not shown in the figure) in contact safe tray 220. When the housing is attached to the surface, surface plunger 282, which is spring-loaded, is depressed and is flush with base 241 (not as shown in the figure). Indicator probe 284 is mechanically coupled to surface plunger 282, so that a displacement, namely a depression and an extension, of surface plunger 282 is transferred to indicator probe 284. When the housing is installed and safe tray 220 is fully inserted into the housing, indicator probe 284 engages the contact switch, yielding a normal state which indicates the bracket is intact against the surface and that safe tray 220 is inserted within housing 235. Should the bracket be removed from the surface (such as upon an attempt to damage or open the key safe), surface plunger 282 indicator extends (as shown in the figure) and a corresponding movement of the indicator probe changes the engagement of the contact switch, yielding an abnormal state. The contact switch is connected to the key safe electronic system, as part of the overall sensing functions described hereinabove. An indication of the abnormal state is thereby transmitted to a remote location and appropriate action may be taken, such as but not limited to dispatching security and repair personnel and notifying others. When the tray is withdrawn from the housing, indictor probe 284 no longer contacts the contact switch. However, should the tray be withdrawn, but not following a command to unlock the safe tray, this could be an indication that the tray was forcibly opened. Such an indication may also be sensed by the key safe electronic system and a signal indicating the indication may be transmitted. In this way, tamper 262 serves to give indications of the integrity of the key safe and to allow further actions to be taken, based upon the indications.

It will be appreciated that the above descriptions are intended only to serve as examples, and that many other embodiments are possible within the scope of the present invention as defined in the appended claims.

What is claimed is:

1. A remotely activated and monitored key safe to allow storage and retrieval of at least one key comprising:

a) a housing having a generally elongated shape and having a longitudinally extending cavity open through a first axial end of the housing, in fixed relation to a structure;

b) a key holding tray adapted to be slideably loaded into the housing, the tray having a front cover fitted to cover the first axial end of the housing, and the tray having a locking/unlocking mechanism;

c) a communications and command subsystem powered by a power source, the communications and command subsystem adapted to receive remote commands to activate the locking/unlocking mechanism; and d) a backup power subsystem adapted to allow backup power to be applied to contacts presentable substantially at the front cover, in case of a failure of the power source, wherein the locking/unlocking mechanism comprises a motor adapted to radially displace a plurality of bolts from the tray when the tray is loaded substantially completely into the housing, yielding a closed state, the locking/unlocking mechanism adapted to yield a locked state of the tray wherein axial movement of the tray is substantially inhibited, and an unlocked state of the tray wherein axial movement of the tray is possible and the tray may be slid towards the first axial end of the housing, yielding an open state.

2. The key safe of claim 1, wherein the communications and command subsystem is adapted to be integrated into the key holding tray and the communications and command subsystem includes at least a transceiver, sensors, a processor, and an antenna.

3. The key safe of claim 2, wherein the sensors are adapted to sense and monitor at least one of a group of states including: closure; opening; locking and unlocking of the safe tray; presence and no presence of the key in the tray; and status of the power supply.

4. The key safe of claim 3, wherein the processor is adapted to process sensor inputs and to provide telemetry information to a remote receiver regarding the inputs, thereby indicating the states of the safe.

5. The key safe of claim 2, wherein the processor is adapted to process commands from a remote location to command the communications and command subsystem.

6. The key safe of claim 2, wherein the communications and command system is configured to receive and send respective command and telemetry information which is transferable by wireless communication.

7. The key safe of claim 2, wherein the communications and command system is configured to receive and send respective command and telemetry information which is transferable by wired communication.

8. The key safe of claim 2, wherein the communications and command system is configured to receive and send respective command and telemetry information which is transferable by wireless and by wired communication.

9. The key safe of claim 1 wherein the power source is a battery.

10. The key safe of claim 1 wherein the power source includes power supplied via wires from a remote source of electricity.

11. The key safe of claim 1, wherein the power source is a battery and power is supplied via wires from a remote source of electricity.

12. The key safe of claim 1, wherein a spring bias mounted on the second axial end of the tray urges the tray to slide out from the housing.

13. The key safe of claim 1, wherein the structure has a first surface and the housing is adapted to be mounted substantially within the structure and substantially perpendicular to the first surface, with the first axial end open towards the first surface.

14. The key safe of claim 13, wherein the structure has a second surface and the housing has a second axial end extending to a second surface of the structure.

15. The key safe of claim 14, wherein the structure is a door.

16. The key safe of claim 1, wherein the structure has a first surface and wherein the housing is adapted to be mounted substantially parallel to the first surface.

17. The key safe of claim 16, wherein the structure is a wall.

18. A method of remotely activating and monitoring a key safe to allow storage and retrieval of at least one key comprising the steps of:

a) providing a housing having a generally elongated shape and having a longitudinally extending cavity open through a first axial end of the housing, the housing mounted securely within a structure and with the first axial end mountable securely in conjunction with a structure;

b) configuring a key holding tray which is slideably loaded into the housing, the tray having a front cover fitted to cover the first axial end of the housing, and the tray having a locking/unlocking mechanism;

c) providing a communications and command subsystem powered by a power source to receive remote commands to activate the locking/unlocking mechanism; and d) providing a backup power subsystem to allow backup power to be applied to contacts presentable substantially at the front cover, in case of a failure of the power source; and e) adapting a motor, as part of the locking/unlocking mechanism, to radially displace a plurality of bolts from the tray when the tray is loaded substantially completely into the housing, thereby yielding a closed state, yielding a locked state of the tray wherein axial movement of the tray is substantially inhibited, and an unlocked state of the tray wherein axial movement of the tray is possible and the tray may be slid towards the first axial end of the housing, yielding an open state.

19. The method of remotely activating and monitoring the key safe of claim 18, wherein the communications and command subsystem is integrated into the key holding tray.

* * * * *